US006714617B2

(12) United States Patent
Valfells

(10) Patent No.: US 6,714,617 B2
(45) Date of Patent: Mar. 30, 2004

(54) DISPOSAL OF RADIATION WASTE IN GLACIAL ICE

(76) Inventor: Ágúst Valfells, Malarhofda 10, Reykjavik (IS)

( * ) Notice: Subject to any disclaimer, the term of this patent is extended or adjusted under 35 U.S.C. 154(b) by 0 days.

(21) Appl. No.: 09/994,307

(22) Filed: Nov. 26, 2001

(65) Prior Publication Data

US 2002/0166981 A1 Nov. 14, 2002

Related U.S. Application Data

(62) Division of application No. 09/338,827, filed on Jun. 23, 1999, now Pat. No. 6,342,650.

(51) Int. Cl.[7] ..... G21C 19/00

(52) U.S. Cl. ..... 376/272; 376/273; 376/912; 250/506.1; 250/515.1; 75/128; 264/0.5; 252/301.8; 405/52; 405/56; 405/57; 405/128; 588/1; 588/2; 588/10; 588/11; 588/15; 588/20; 588/249; 588/252

(58) Field of Search ..... 588/1, 2, 10, 11, 588/15, 20, 249, 252; 405/52, 56, 57, 128; 252/301.8; 264/0.5; 75/128; 376/272, 912, 273; 250/506.1, 515.1

(56) References Cited

U.S. PATENT DOCUMENTS

| | | | | | |
|---|---|---|---|---|---|
| 3,093,593 | A | * | 6/1963 | Arrance | 252/301 |
| 3,249,551 | A | * | 5/1966 | Bixby | 252/301.1 |
| 4,040,480 | A | * | 8/1977 | Richards | 166/57 |
| 4,072,501 | A | * | 2/1978 | Quinby | 75/344 |
| 4,115,311 | A | * | 9/1978 | Sump | 252/301.1 |
| 4,204,975 | A | * | 5/1980 | Thiele | 588/15 |
| 4,291,536 | A | * | 9/1981 | Girard | 60/644.1 |
| 4,320,028 | A | * | 3/1982 | Leuchtag | 588/11 |
| 4,338,215 | A | * | 7/1982 | Shaffer et al. | 588/15 |
| 4,375,930 | A | * | 3/1983 | Valiga | 588/252 |
| 4,383,855 | A | * | 5/1983 | Aaron et al. | 419/19 |
| 4,383,944 | A | * | 5/1983 | Ondracek | 588/11 |
| 4,431,349 | A | * | 2/1984 | Coursen | 405/303 |
| 4,472,347 | A | * | 9/1984 | Quillmann et al. | 376/272 |
| 4,488,990 | A | * | 12/1984 | Yannopoulos | 588/11 |
| 4,500,227 | A | * | 2/1985 | Courtois et al. | 405/129.35 |
| 4,652,181 | A | * | 3/1987 | Bergman et al. | 405/129.35 |
| 4,659,511 | A | * | 4/1987 | Fukasawa et al. | 588/4 |
| 4,708,522 | A | * | 11/1987 | Bergman et al. | 405/55 |
| 4,726,916 | A | * | 2/1988 | Aubert et al. | 588/10 |
| 4,814,046 | A | * | 3/1989 | Johnson et al. | 205/47 |
| 4,906,135 | A | * | 3/1990 | Brassow et al. | 405/129.35 |
| 4,980,093 | A | * | 12/1990 | Ohtsuka et al. | 588/20 |

(List continued on next page.)

FOREIGN PATENT DOCUMENTS

| | | |
|---|---|---|
| DE | 3213071 | * 10/1983 |
| EP | 0347255 | * 12/1989 |

OTHER PUBLICATIONS

Magill et al, "Closing the Fuel cycle with ADS", International workshop on the physics of accelerator driven systems for nuclear transmutation and clean energy production, Sep. 29–Oct. 3, 1997, Treno, Italy, pp. 1–12.*

Persson, "A process for recovery of actinides from reprocessing high–level liquid waste" ISBN 91–7032–115–9, Goteborg, Sweden, 1983.*

Valfells, Agust, et al., Certain Aspects of Utilizing Some of the World's Energy Resources for Sustainable Development, pp. 1–22, presented at 16$^{th}$ Congress of the World Energy Council (WEC) in Tokyo Oct. 8–13, 1995.

*Primary Examiner*—Michael J. Carone
*Assistant Examiner*—John Richardson
(74) *Attorney, Agent, or Firm*—McKee, Voorhees & Sease, P.L.C.

(57) ABSTRACT

Encapsulating calcined radioactive waste in strong, corrosion-resistant spheres of dimensions such that heat from the radiation melts the ice at a rate which brings the spheres to the bottom of the permanent icefield in a relatively short time, with the resulting waste ultimately being no more hazardous than natural uranium ore.

3 Claims, 2 Drawing Sheets

U.S. PATENT DOCUMENTS 5,169,566 A * 12/1992 Stucky et al. ..... 264/255
5,304,708 A * 4/1994 Buehler ..... 588/256
5,317,608 A * 5/1994 Pearcy et al. ..... 376/261
5,338,493 A * 8/1994 Welch ..... 588/16
5,616,928 A * 4/1997 Russell et al. ..... 250/515.1
5,700,962 A * 12/1997 Carden ..... 75/236
5,850,614 A * 12/1998 Crichlow ..... 588/17
5,879,110 A * 3/1999 Carter, Jr. ..... 405/267
5,890,840 A * 4/1999 Carter, Jr. ..... 405/129.55
5,905,184 A * 5/1999 Carter, Jr. ..... 588/260
5,980,602 A * 11/1999 Carden ..... 75/236
6,495,846 B1 * 12/2002 Vaughan ..... 250/506.1

* cited by examiner

DISPOSAL OF RADIATION WASTE IN GLACIAL ICE

FIELD OF THE INVENTION

This invention relates to fission product disposal in permanent icefields.

BACKGROUND OF THE INVENTION

One of the major impediments to the social acceptance of nuclear power is the still unresolved question of the disposal of the radioactive high level waste from nuclear reactors. Presently the spent fuel rods are mostly being stored on site and the solution to the problem being postponed. Meanwhile, spent fuel from most of the world's reactors accumulates and the problem becomes ever more serious. The longer a decision on the method of disposal to be used is postponed, the greater becomes the probability of a serious nuclear related accident or intentionally motivated major incident.

The solution to the disposal problem has to ensure the safe isolation of the radioactive waste from the biosphere while it remains hazardous. Technically this should not be a major problem, but it has to be done in an environmentally and socially acceptable manner, as well as in a manner to insure inaccessibility for security reasons.

Simply put, a debt that is owed to future generations is to minimize the hazard from the radioactive legacy that we have already left them. It takes hundreds of thousands of years for the ingestion hazard index from unreprocessed spent fuel from light water reactors to diminish until it is no more than that from the naturally occurring uranium that the fuel originated from. (See for ex. Benedict, M., Pigford, T. H., Levi H. W., *Nuclear Chemical Engineering*, McGraw Hill Book Company, New York, 1981, p.573 and p.623). If, on the other hand, the fuel is reprocessed and the actinides removed and disposed of, that time can be shortened to a time span of the order of a thousand years. Hence, for a cleaner future environment one should preferably also reclaim and "burn" the plutonium that presently exists in spent nuclear fuel. For example, according to Albright, F. B., Walker, W., *World Inventory of Plutonium and Highly Enriched Uranium* 1992, Oxford University Press, Oxford, 1993, the sum of already accumulated spent nuclear fuel and that which is projected to the year 2000 is about 220,000 tonnes. At a burnup, roughly estimated; of 30,000 Mwd/tonne (of fuel) this corresponds to thermal energy production of 6,600,000,000 Mwd. Since each Megawatt-day of energy production is accompanied by the formation of just about 1.04 g. of fission products the quantity of fission products accumulated worldwide up to the end of the millenium is close to 7,000 tonnes.

The corresponding Plutonium content of the spent fuel is estimated at 1390 tonnes, if all this is fissioned it corresponds to an additional 1,338,000,000 Mwd or 20% of the energy already realized from the spent fuel. With continuous reprocessing and recycling that converts more Uranium-238 into plutonium that figure roughly doubles adding yet another 20%. Apart from providing energy the recycled Plutonium would be disposed of as a very long lived radiation hazard and potential nuclear weapons material.

Accordingly, it can be seen that there is a real and a continuing need for safe effective disposal of fissile isotopes and fission products in a manner that creates no environmental hazard for present or future generations. This invention has, as its primary objective, helping to fulfill this need.

SUMMARY OF THE INVENTION

Figure 1:
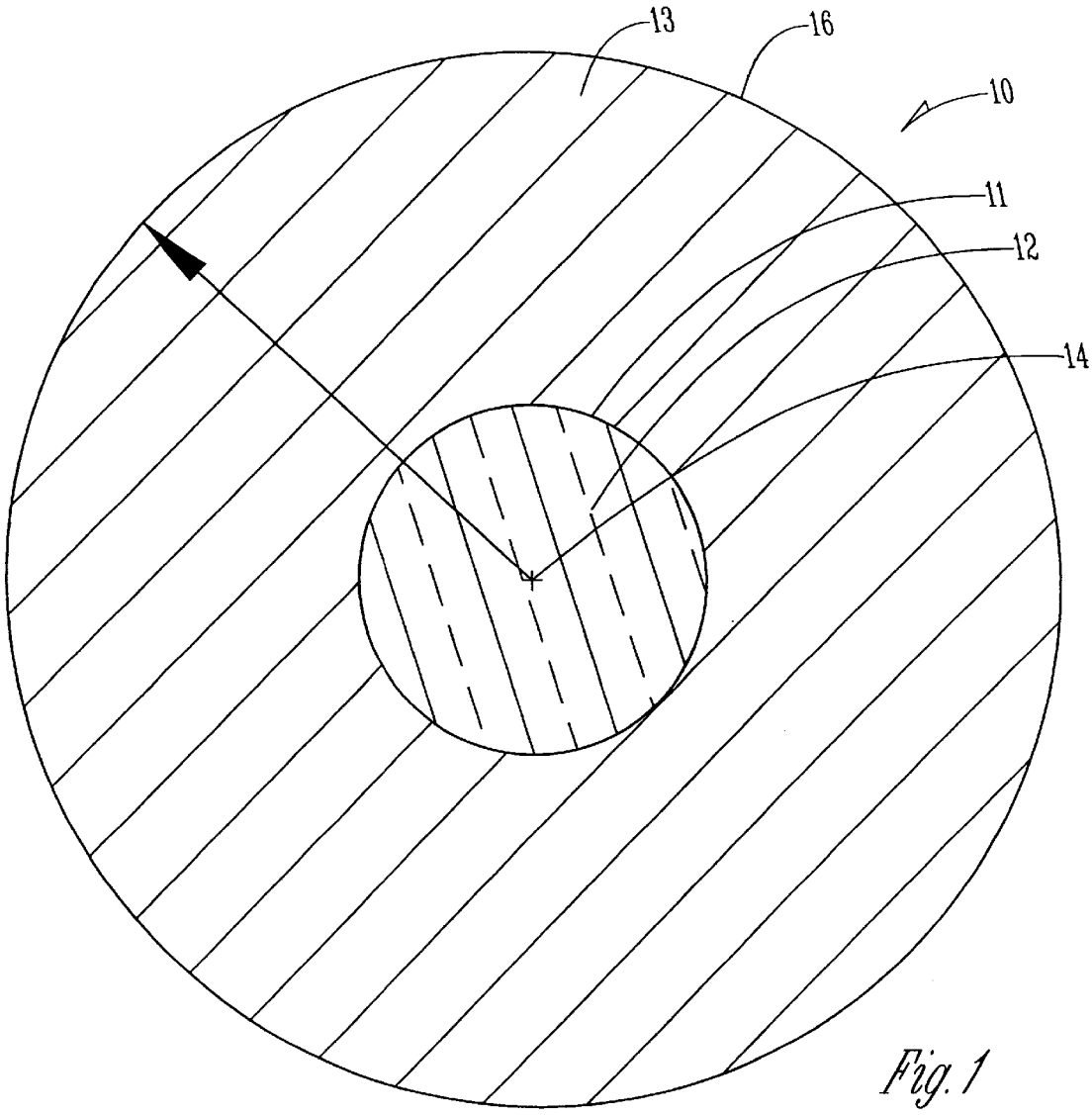
FIG. 1 shows one a cross section of possible configuration and dimensions for spherical disposal containers useful in the present invention.

This invention involves radioactive waste disposal in deep permanent ice. Properly carried out, it has the advantage of isolating the high level radioactive waste from the biosphere in remote areas, far from human habitation. The isolation from the environment can last for sufficiently long to ensure that the ingestion hazard index posed by the waste is no more than that associated with the uranium ore that it originated from. Furthermore, disposal in deep permanent ice provides for relatively easy placement of the radioactive waste in its ultimate repository by letting it melt its way to the bottom, while making it exceedingly hard to retrieve from glacial depths as the ice will refreeze over it.

DETAILED DESCRIPTION OF THE INVENTION

It was mentioned above that the hazard index for fission products, after separation from the actinides, declined to the same value as that of natural uranium in a time span of the order of a thousand years. Reprocessing on such a basis leaves less of a radioactive legacy for future generations than the alternative of not reprocessing. Such a process encourages use of nuclear power with a simultaneous suggestion of the means of ultimate disposal of radioactive waste. Recent drillings in the central Greenland icecap have revealed a stability that has a time scale of a hundred thousand years. Encapsulating radioactive waste, preferably in solid form, in such amounts and in sufficiently strong and corrosion-resistant containers of such size that the heat from the radiation should suffice to melt the ice at a rate which brings them relatively quickly to the bottom, is possible. After about 800–1000 years the waste will be no more hazardous than the natural uranium which undoubtedly is to be found in many places underneath the ice cap. Antarctica would be even more suitable for disposal because of its remoteness from any human habitation, now or in the foreseeable future.

The following calculations and configuration description for the spherical capsules demonstrate the feasibility of the invention with respect to the spheres shown in FIG. 1 which are described below. The example is offered as illustrative, but not limiting.

EXAMPLE

As an example of a disposal site, the central Greenland icecap was chosen. Recent drillings to the bottom of the ice have shown that it has remained stable for 100,000 years. Borehole temperature varies from −35° C. on top to about −10° C. at the bottom.

For the fission product disposal, a typical power reactor, namely a 1000 MWe reactor, was chosen as the reference case. A 1000 MWe reactor operating at 33% efficiency will generate 3.12 kg of fission products per day. Typically about 100 metric tons (i.e. Megagrams, Mg, or tonnes) of fuel will be irradiated in a power reactor to a burnup of 2600 TJ per ton of reactor fuel (30,000 Megawatt days per tonne). One third of the fuel is generally replaced annually, giving a residence time of three years. Annual reactor operation for 330 days will thus generate 330×3.12=1029.6 kg of fission products, or just about one tonne.

From yield tables for the fission of U235 (Benedict, M. and Pigford, T., et al., *Nuclear Chemical Engineering,* 2nd ed., McGraw Hill, New York, 1981) and density data (Emsley, J., *The Elements*, Oxford University Press, Oxford, 1989) it can be shown that fission products from one tonne of U235 fissioned will, when Xenon and Krypton are discounted, produce close to 834 kilograms of elemental fission products that have a mean density of 4200 kg/m$^3$. If the fission products apart from Xenon and Krypton are in oxide form (assuming the highest oxidation states), one tonne of U235 will generate about one tonne of fission product oxides. These will have a mean density of about 4260 kg/m$^3$ and occupy a volume of 0.237 m$^3$. The results of such a calculation are shown in Table 1.

amount and the concentration of the fission products 12 which can be encapsulated in one unit 10; (2) the radiation outside the capsule 10, which must not exceed safety limits while being handled and transported prior to burial in the ice; and (3) the outside surface 16 temperature of the capsule which must be sufficient to melt the ice while it is reaching bottom, yet not sufficiently high to seriously enhance corrosion of the capsule.

The constraint that the fission products (in oxide form in this example) 12 at the center of the container shall remain solid and preferably none to decompose, puts very strict limitations on how high the temperature can be allowed to rise at the center 14. Ultimately this depends on the rate of heat generation per unit volume in the core 11 that the fission products 12 are embedded in, the volume they occupy, their age, the material they may be mixed with, and the rate of

TABLE 1

DATA PERTAINING TO FISSION PRODUCTS

| FISSION PROD. | YIELD Atoms/fiss | ATOMIC WT. g/g-atom | MASS g | DEN-SITY g/cm$^3$ | VOLUME cm$^3$ | OXIDE | MOL. WT. g/mole | YIELD mol./fiss. | MASS g | DEN-SITY g/cm$^3$ | VOLUME cm$^3$ | COMM. |
|---|---|---|---|---|---|---|---|---|---|---|---|---|
| (Light) | | | | | | | | | | | | |
| Kr | 0.032 | 84 | (2.668) | — | — | — | — | — | — | — | — | |
| Rb | 0.028 | 85 | 2.38 | 1.5 | 1.5866667 | $Rb_2O$ | 186 | 0.014 | 2.604 | 3.7 | 0.7037838 | d. 400° C. |
| Sr | 0.074 | 89 | 6.586 | 2.6 | 2.5330769 | SrO | 105 | 0.074 | 7.77 | 4.7 | 1.6531915 | |
| Y | 0.038 | 89 | 3.382 | 4.5 | 0.7515556 | $Y_2O_3$ | 226 | 0.019 | 4.294 | 5 | 0.8588 | |
| Zr | 0.281 | 91 | 25.571 | 6.5 | 3.934 | $ZrO_2$ | 123 | 0.281 | 34.563 | 3.25 | 10.634769 | |
| Mo | 0.241 | 96 | 23.136 | 10.2 | 2.2682353 | $MoO_3$ | 144 | 0.241 | 34.704 | 4.7 | 7.3838298 | |
| Tc | 0.058 | 98 | 5.684 | 11.5 | 0.4942609 | $Tc_2O_7$ | 308 | 0.029 | 8.932 | 3.9 | 2.2902564 | |
| Ru | 0.141 | 101 | 14.241 | 1.5 | 9.494 | $RuO_4$ | 165 | 0.141 | 23.265 | 3.3 | 7.05 | |
| Rh | 0.024 | 103 | 2.472 | 21 | 0.1177143 | $RhO_2$ | 135 | 0.024 | 3.24 | 7.1 | 0.456338 | |
| Pd | 0.067 | 106 | 7.102 | 12 | 0.5918333 | $PdO_2$ | 138 | 0.067 | 9.246 | 6.2 | 1.4912903 | |
| SUM: | 0.984 | SUM: | 90.554 | SUM: | 21.771343 | | | SUM: | 90.554 | SUM: | 32.522259 | |
| (Heavy) | | | | | | | | | | | | |
| Te | 0.029 | 128 | 3.712 | 6.2 | 0.5987097 | $TeO_3$ | 176 | 0.029 | 5.104 | 5.1 | 1.0007843 | |
| I | 0.012 | 127 | 1.524 | 4.9 | 0.3110204 | $I_2O_5$ | 334 | 0.006 | 2.004 | 4.8 | 0.4175 | d. 300° C. |
| Xe | 0.276 | 131 | (36.156) | — | — | — | — | — | — | — | — | |
| Cs | 0.135 | 133 | 17.955 | 1.8 | 9.975 | $Cs_2O$ | 282 | 0.067 | 18.894 | 4.3 | 4.3939535 | |
| Ba | 0.067 | 137 | 9.179 | 3.7 | 2.4808108 | BaO | 153 | 0.067 | 10.251 | 5.7 | 1.7984211 | |
| La | 0.062 | 139 | 8.618 | 6.1 | 1.4127869 | $La_2O_3$ | 326 | 0.031 | 10.106 | 6.5 | 1.5547692 | |
| Ce | 0.133 | 140 | 18.62 | 6.7 | 2.7791045 | $CeO_2$ | 172 | 0.133 | 22.876 | 7.1 | 3.2219718 | |
| Pr | 0.059 | 141 | 8.319 | 6.7 | 1.2416418 | $PrO_2$ | 173 | 0.059 | 10.207 | 6.8 | 1.5010294 | |
| Nd | 0.184 | 144 | 26.496 | 7 | 3.7851429 | $Nd_2O_3$ | 336 | 0.184 | 61.824 | 7.2 | 8.5866667 | |
| Sm | 0.035 | 150 | 5.25 | 7.5 | 0.7000000 | $Sm_2O_3$ | 348 | 0.017 | 5.916 | 8.3 | 0.7127711 | |
| SUM: | 0.992 | SUM: | 99.673 | SUM: | 23.284217 | | | SUM: | 147.182 | SUM: | 23.187867 | |

Mean density of solid fission products: 4.22 g/cm$^3$
Mean density of oxides approximately 4.26 g/cm$^3$
For every 235 g. U-235 fissioned Xe and Kr account for 39 g. leaving 196 g. of other fission products. Thus 1 ton of f.p. formed leaves 834 kg. of elemental f.p.'s other than Xe and Kr.
For every 235 g. U-235 fissioned the fission product oxides (assuming highest oxidation state) amount to approximately 240 g. Thus one ton of fission products will generate about 1 ton of fission product oxides (Xe and Kr discounted). At a mean density of 4.26 kg/l this will occupy 0.235 m$^3$.

It is given that the actinides should be separated from the fission products to the maximum feasible extent because of their long life. They can be reprocessed to be used mostly as fuel. The remaining fission products will have to be isolated from the environment for 800–1000 years, after which they are no more hazardous than the uranium ore from which they originated, or the uranium ore that must also exist naturally under such large icecaps as the Greenland icecap.

FIG. 1 shows a typical disposal capsule (spherical in this example) configuration and its dimensions. The constraints on the design of a capsule 10, which consists of a core matrix 11 in which the fission products 12 are embedded and a radiation shield 13, to transport them through the ice are: (1) the temperature at the center 14, which limits both the heat removal. The heat removal rate, in turn, depends upon the size of the container 10, the thermal conductivity of the core 11 and shield 13, as well as the thermal conductivity of the surrounding environment (i.e., whether it is air, water, or ice). The second criterion listed above also depends upon the core volume containing the fission products 12, the materials they are mixed with, and the thickness of the shield 13, as well as its material. The same factors apply to the third criterion. The restrictions that these criteria impose may overlap, yet all three have to be met.

The best solution is to start by storing the spent fuel for a period to let the short lived fission products decay. All things considered, a period of ten years seems desirable. Then the fuel should be reprocessed and the fission products separated from the actinides. The latter should be recycled and fissioned or transmuted into shorter lived isotopes. The extended storage and the removal of the actinides greatly relaxes both the shielding and thermal constraints. None the less, it was found that the thermal restrictions still necessitated dividing the ton of fission product oxides into smaller portions to be individually encapsulated. The size of the portions depends on the core temperature restrictions which, in turn, depend on whether the fission products (or their oxides in this example) are mixed with another material or not and, if so, which material. A conservative approach would be to embed the claimed fission products 12 in a metal matrix , similar to what is done in the PAMELA process (Benedict, M., Pigford, T.H., Levi H.W., Nuclear Chemical Engineering, McGraw Hill Book Company, New York, 1981), which is incorporated herein by reference. This entails a lead (Pb) content of 33% by volume. A lead (Pb) alloy, such as a tin (Sn) lead (Pb) alloy, or some other metal may also be used. However, lead's (Pb) or the lead (Pb) alloy's low melting point and poor thermal conductivity limit the total energy that may be released by radiation within each sphere to much lesser values than a metal with a higher melting point, or thermal conductivity such as copper. Copper, on the other hand, may be incompatible with some of the more volatile fission products or their unstable oxides when molten copper is applied to form the embedding matrix. This might require separate handling for the volatile fission products such as iodine. However, the embedding matrix may also be deposited by electrochemical means. Copper also has a lower linear absorption coefficient for gamma rays than does lead (Pb).

During the storage period many fission products with short half lives become insignificant as radiation sources. The more pertinent ones from a shielding point of view are listed in Table 2. Because of the low penetrating power of beta radiation, only gamma shielding needs consideration. The shield can be made of a variety of corrosion resistant materials that have good radiation shielding and thermal characteristics, certain grades of stainless steel being among them.

An accurate shield 13 design, of for example stainless steel (other known corrosion resistant materials can also be used), requires a multi-group-multi-region calculation, but a less precise analytical approach will be used here which none the less is sufficiently accurate for illustrative design purposes. The basis for the capsule design in this example will be 100 kg of fission products embedded in oxide form in a lead (Pb) matrix where the fission product oxide content is 67% by volume. The volume occupied by the oxides and the lead (Pb) is referred to as the core volume. Averaging of density data from Table 1 and the density of lead (Pb) will give an average density of 6600 kg/m$^3$ for the core volume. For 100 kg of fission products this volume will be 0.036 m3 which corresponds to a radius of just about 0.2 m$^3$. From Table 2 it is seen that the average gamma energy is 0.72 Mev. This gives the core a mass absorption coefficient of 0.085 cm$^2$/g, which at the given density corresponds to a linear absorption coefficient of 0.563 cm$^{-1}$. The reciprocal, namely the relaxation length, $\lambda_c$, will be 1.77 cm or 0.0177 m for the core volume. For the stainless steel encapsulating the core, with a density of 7800 kg/m$^3$ and a corresponding mass absorption coefficient of 0.073 cm$^2$/g, the value of the relaxation length turns out to be almost the same, or 0.0176 m.

From Table 2 it is seen that the gamma flux for the ton or so of fission product oxides that stem from 33 tons of spent fuel that has been stored for ten years is $1.042\times10^{17}$ photons/s. When the fission product oxides are subdivided into the 100 kg lots as are contained in the core volume, it is seen that the gamma radiation from the core is $1.042\times10^{17}\times0.1=1.042\times10^{16}$ photons/s. Given the core volume of 0.036 m$^3$, this will give a core volume unit strength, S(ν,γ), Of:

$$S(\nu,\gamma)=1.042\times10^{16}/0.036=2.894\times10^{17}\ \text{photons}/s\ m^3 \quad (1)$$

The corresponding surface flux, S(a,γ), from the core will be:

$$S(a,\gamma)=\lambda_c S(\nu,\gamma)=0.0177\times2.894\times10^{17}=5.123\times10^{15}\ \text{photons}/s\ m^2 \quad (2)$$

TABLE 2

ACTIVITY OF MAJOR FISSION PRODUCTS AFTER TEN YEARS OF COOLING

| FISSION PROD. | HALF LIFE effective, yr. | A(6 yr.) Curies | A(10 yr.) beta Becquerels | E(beta) Mev | A(10) * E Beta W | A(10 yr) gamma Becquerels | E(gamma) Mev | A(10) * E gamma W |
|---|---|---|---|---|---|---|---|---|
| Sr 90 | 28.1 | $5.940\times10^4$ | $1.991\times10^{15}$ | 0.546 | $1.742\times10^2$ | | 0 | 0.000 |
| Y 90 | 28.1 | $5.940\times10^4$ | $1.991\times10^{15}$ | 2.27 | $7.242\times10^2$ | | 0 | 0.000 |
| Ru 106 | 1 | $6.120\times10^3$ | $1.416\times10^{13}$ | 0.0394 | $8.938\times10^{-2}$ | | 0 | 0.000 |
| Rh 106 | 1 | $6.120\times10^3$ | $1.416\times10^{13}$ | 1.43 | 3.244 | $1.416\times10^{13}$ | 0.34 | $7.713\times10^{-1}$ |
| Cs 134 | 2.05 | $2.450\times10^4$ | $2.345\times10^{14}$ | 0.502 | $1.886\times10^1$ | $2.345\times10^{14}$ | 1.56 | $5.860\times10^1$ |
| Cs 137 | 30.23 | $8.470\times10^4$ | $2.859\times10^{15}$ | 1.176 | $5.387\times10^2$ | | 0 | 0.000 |
| Ba 137 m | 30.23 | $7.920\times10^4$ | $2.674\times10^{15}$ | 0 | 0.000 | $2.674\times10^{15}$ | 0.662 | $2.835\times10^2$ |
| Ce 144 | 0.78 | $3.320\times10^3$ | $3.515\times10^{12}$ | 0.138 | $7.771\times10^{-2}$ | | 0 | 0.000 |
| Pr 144 | 0.78 | $3.320\times10^3$ | $3.515\times10^{12}$ | 1.276 | $7.185\times10^{-1}$ | $3.515\times10^{12}$ | 0.031 | $1.746\times10^{-2}$ |
| Pm 147 | 2.5 | $1.900\times10^4$ | $2.320\times10^{14}$ | 0.225 | 8.361 | $2.320\times10^{14}$ | 0.622 | $2.311\times10^1$ |
| Sm 151 | 93 | $1.120\times10^3$ | $4.022\times10^{13}$ | 0.03 | $1.933\times10^{-1}$ | | 0 | 0.000 |
| Eu 154 | 16 | $4.710\times10^3$ | $1.465\times10^{14}$ | 0.142 | 3.334 | | 0 | 0.000 |
| SUMS: | | $3.509\times10^5$ | $1.020\times10^{16}$ | | $1.472\times10^3$ | $3.158\times10^{15}$ | | $3.660\times10^2$ |

E(beta) av.: = 0.9004001 Mev; E(gamma) av.: = 0.7235982 Mev
A(10,beta): = $1.02\times10^{16}$ particles/s; A(10,gamma): = $3.158\times10^{15}$ photons/s
Watts: betawatts: = 1470.0592 gammawatts: = 365.59223 Tot. watts: = 1836 W/Mg of fuel
Conv. fact.: Bq/Ci = $3.7\times10^{10}$ J/Mev = $1.602\times10^{-13}$
Total activity for 33 tons of fuel: beta dis/s: = $3.367\times10^{17}$ gamma phot./s: = $1.042 = 10^{17}$
Total heat generated for 33 tons of fuel: = 60576 W
BASIS IS PER TONNE OF HEAVY METAL (FUEL) TEN YEARS AFTER DISCHARGE If the criterion is set that the gamma energy flux outside the shield should not exceed five nanowatts/m$^2$, this would correspond to a flux of about 50,000 photons/s m$^2$ as the average gamma photon energy is 0.7 Mev. For a reasonable approximation for the necessary shield thickness for a spherical surface source one can use the expression (See Glasstone, S. and Sesonsky, A., *Nuclear Reactor Engineering*, D. Van Nostrand and Co., New York, 1963, Chapter 10).

$$\phi(z)=B(z)(S(a,\gamma)(r/r(i))E_1(z/\lambda)/2 \quad (3)$$

where:

$\phi(z)$=gamma flux outside the shield=50,000 photons/s $m^2$.

B(z)=Buildup factor here taken as=1.

r=distance from center of the sphere to the detector, m.

r(i)=radius of spherical source=0.2 m.

z=distance from surface of the source to the detector, m.

$\lambda$=relaxation length of gamma photons in shield=0.0177 m.

$E_1(z/\lambda)$=the exponential integral of the first order of $z/\lambda$.

For large values, such as here, the approximation $E_1(x)=\exp(-x)/x$ may be used. If the detector is at the outer surface of the shield 16, z=r−r(i). With the above established numbers the solution to eq'n (3) then gives a value of r=0.6 m., i.e. the shield thickness will be 0.4 m.

Whereas the beta activity could be ignored for the purposes of shielding calculations, it is a major contributor to the generation of thermal power in the core 11. From Table 2 it is seen that the beta activity of the major fission products after ten years of storage contributes 1470 W. per tonne of spent fuel, or 3.3×1470=4851 W. for the 3.3 tonnes that correspond to the 100 kg of fission product oxides in the core volume. Corresponding gamma energy is 365×3.3=1205 W. This gives a total heat rate of 4851+1205=6056 W. for the core volume.

As essentially all the beta radiation is absorbed within the core volume because of its low penetrating power, all the associated heating may be considered arising there. The gamma radiation penetrates into the shield, as was borne out by the shielding calculations. However, the bulk (i.e. 95%) of the gamma heat energy is deposited in the first three relaxation lengths of shield enclosing the core (and much of that in the first cm or so). For the present case the gamma heating in the shield may be ignored for heat transmission purposes and all the gamma heat also considered to stem from the core volume. (The incurred error should not exceed 3%). Using the previously calculated figures for heat generation rate and core volume, the specific rate of heat generation in the core, S(v,q), is found to be 6056/0.036=168,222 W/$m^3$.

The Poisson equation describes the relationship between heat generation, thermal conductivity, k, and the temperature profile for the steady state case:

$$\nabla^2 T+S(v,q)/k=0 \quad (4)$$

In spherical coordinates, with the boundary conditions that T(c) is the temperature at the center and T(i) its value at the surface of the fission product sphere of radius r(i), the solution is:

$$T(c)-T(i)=S(v,q)r(i)^2/(6k) \quad (5)$$

The value of k for the core is taken as 10 W/m deg. C. (Benedict, M. and Pigford, T., et al., *Nuclear Chemical Engineering,* 2nd ed., McGraw Hill, New York, 1981 p. 584). Then using the values calculated above, i.e. S(v,q)=168,222 W/$m^3$ and r(i)=0.2 m:

$$T(c)-T(i)=168{,}222\times 0.2^2/(6\times 10)=112\ deg.\ C. \quad (6)$$

For the shield, when S(v,q) becomes zero, the Poisson equation simplifies to the Laplace equation:

$$\nabla^2 T=0 \quad (7)$$

the solution of which is:

$$T(i)-T(o)=(q/4\pi k)(l/r(i)-1/r(o)) \quad (8)$$

where r(o) signifies the outer radius of the shield and T(o) the corresponding temperature and q the rate of heat transfer through the shield. The value of k, the heat transfer coefficient, for the stainless steel is taken as 18 W/m deg C. With the appropriate numbers introduced into the equation, the temperature drop across the shield is found to be:

$$T(i)-T(o)=(6056/4\pi\times 18)(1/0.2-1/0.6)=89\ deg\ C. \quad (9)$$

Figure 2:
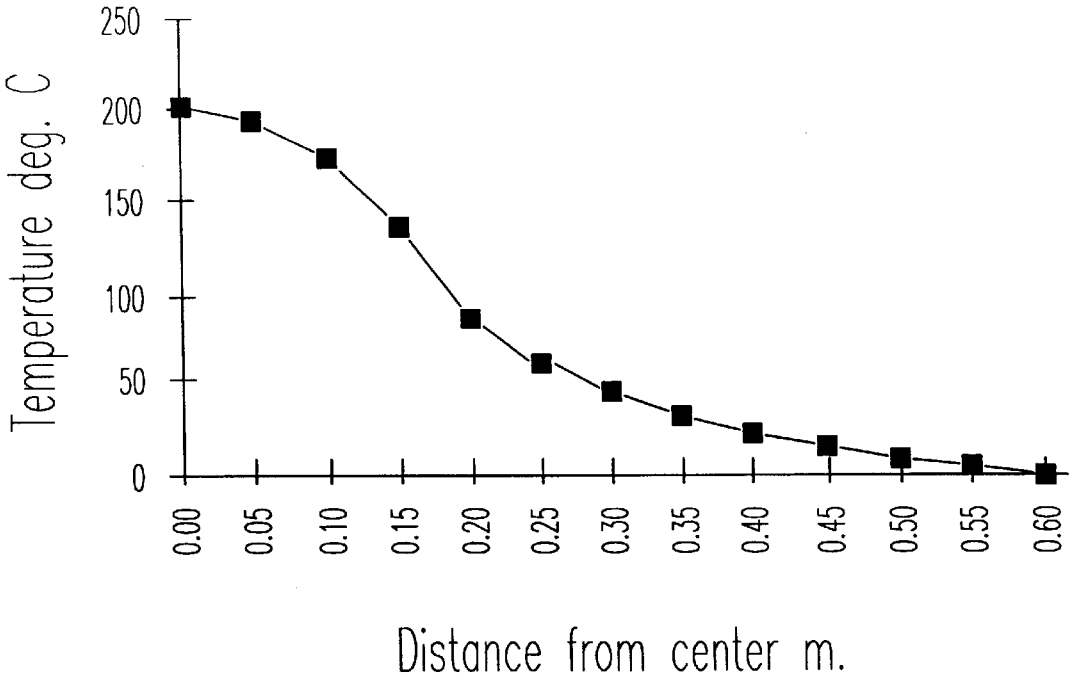
FIG. 2 shows a temperature profile for both core and shield for the spheres of the present invention.

The temperature profile for both core and shield is shown in FIG. 2. The temperature drop from the center of the core to the outer surface of the shield is 89+112=201 deg C.

The ratio of the thermal conductivities of ice (2.24 W/m deg C.) and stainless steel are such that even if the surface ice is at −35° C., it cannot conduct the heat away fast enough to prevent melting at the rate of heat generation under consideration. The temperature gradient in the water boundary layer adjacent to the surface of the sphere will be steeper than in the shield and raise the sphere surface temperature somewhat above the freezing point. Once an icemelt is formed, convection will also play a part in cooling the sphere but the exact calculation is quite complicated and will not be undertaken here.

In the central region of the Greenland Icecap (or Antarctica) the sphere will have to melt a volume of ice that equals its own diameter and is 3000 m in height. Given the density of ice at 900 kg/$m^3$ and the radius of the sphere of 0.6 m, the mass of ice, m, that the sphere will have to melt will be:

$$m=900\times\pi\times 0.6^2\times 3000=3.053\times 10^6\ kg \quad (10)$$

Besides melting the ice the sphere has to heat the ice from the ambient temperature to the melting point. The former varies from −35° C. at the surface to −10° C. or so at the bottom, as mentioned earlier, and the melting point somewhat because of pressure increase with depth. Nonetheless, for a conservative estimate the temperature will be considered constant at −35° C. and the melting point also constant. The heat of fusion of water is 334 kJ/kg and the specific heat of ice just about 2 kJ/kg deg C. The total heat required to heat the ice from −35° C. and melt the sphere to the bottom, Q, will thus be:

$$Q=3.053\times 10^6\times(2\times 35+334)=1.233\times 10^9\ kJ \quad (11)$$

or $1.233\times 10^{12}$ J.

After ten years of storage the dominant fission products are Sr 90 and Cs 137 in secular equilibrium with their daughter nuclides, Y 90 and Ba 137 m. Sr 90 and Cs 137 decay with very similar half lifes, namely nearly 29 years for both. For these reasons the ten year old mixture of fission products under consideration here may be considered to have a half life of 29 years for heat generation purposes. (This can change with time as the strontium and cesium isotopes decay further over a period of centuries, which leaves some longer lived nuclides dominant). Hence the effective decay constant for the fission product mixture, $\lambda_d$, will have the value:

$$\lambda_d=1n(2)/t_{1/2}=0.693/30=0.0231\ \text{per year} \quad (12)$$

To be commensurate with watts $\lambda_d$ should be expressed in reciprocal seconds, that is $\lambda_d=0.0231/3.156\times10^7=7.320\times10^{-10}$ per second where the denominator is the number of seconds in a year. The rate of heat generation, q, as a function of time will then be given by $q(t)=q_{10}\exp(-\lambda_d t)$. The heat output must be integrated over the time that it takes the radwaste sphere to reach the bottom of the glacier, t(b). This has to equal the total heat requirements, Q, calculated above. Hence:

$$Q=\int_0^{t(b)} q_{10}\exp(-\lambda_d t)\,dt \tag{13}$$

where, as before:

$\lambda_d$=effective decay constant at ten years=$7.320\times10^{-10}$ $s^{-1}$ $q_{10}$=decay heat rate of ten year old fission products=6056 W.

Q=total heat requirements for reaching bottom=$1.233\times10^{12}$ J.

Solving for t(b) yields the expression:

$$t(b)=(1/\lambda_d)ln(l-\lambda_d Q/q_{10}) \tag{14}$$

or, when the numbers are substituted:

$$t(b)=(1/7.32\times10^{-10})ln(1-7.32\times10^{-10}\times1.233\times10^{12}/6056)=2.205\times10^8\ s \tag{15}$$

which is equivalent to $2.205\times10^8/3.156\times10^7=7.0$ years.

This example and its calculations demonstrate the feasibility of storing nuclear wastes in a safe manner in deep permanent icefields. It should be recalled that the assumption was made that spent fuel reprocessing would be undertaken and the long lived actinides recycled, or disposed of by other means. That is not to say that ice burial might not be considered for them as well, whether separately or unseparated from the fission products. Although separation and recycling of the actinides is preferable, an assured storage of the actinides for 100,000 years would diminish the activity of the plutonium by a factor of 16.

Although the Greenland glacier was taken as an example in this study, it should be borne in mind that from a disposal point of view Antarctica would be even better because of its remoteness and greater depth of the ice.

The disposal of fission products in deep permanent icefields as is described here is a technically feasible solution to the worrisome problem of accumulating nuclear waste in many countries. Apart from providing permanent storage (in any case long enough for the fission product activity to cease being a hazard and a time period of the order of 100,000 years), the fission products are adequately shielded in remote unpopulated areas. Furthermore, they are easily placed in storage but become inaccessible a few years if not months after they are placed on the ice. This holds the promise of making it a much more cost effective solution than deep geological burial, or shooting the nuclear wastes into space, as has been proposed. It therefore can be seen that the invention accomplishes all of its stated objectives.

What is claimed is:

1. A spherical radiation waste container for use in storage of fission products, separated from actinides in deep permanent ice, comprising:

a spherical corrosion resistant container having a core filled with said fission products separated from actinides initially mixed with said fission products, and said fission products consisting essentially of Sr-90, Cs-137 as the dominant fission products, said fission products being in a metal matrix of spherical configuration to successfully encapsulate and store said fission products, said core and said metal matrix being dimensionally configured to define a waste container such that the radiation outside the waste container does not exceed human safety limits and such that the container surface reaches a temperature sufficiently high to melt ice, but not cause corrosion of the container surface, nor render the temperature at the center too high, and in manner wherein the time taken to reach the bottom of the said permanent ice, such as the Greenland icecap, is of the order of 7 years.

2. The container of claim 1 wherein the metal matrix is a lead (Pb) matrix.

3. The container of claim 1 wherein the corrosion resistant container is stainless steel.

* * * * *